US009958800B2

(12) United States Patent
Chimoto et al.

(10) Patent No.: US 9,958,800 B2
(45) Date of Patent: May 1, 2018

(54) TONER

(71) Applicant: CANON KABUSHIKI KAISHA, Tokyo (JP)

(72) Inventors: Yuya Chimoto, Funabashi (JP); Hayato Ida, Toride (JP); Takaho Shibata, Tokyo (JP); Junichi Tamura, Toride (JP); Kouichirou Ochi, Chiba (JP); Ryuji Murayama, Nagareyama (JP); Daisuke Yamashita, Kashiwa (JP); Tomoyo Miyakai, Kashiwa (JP); Takashi Hirasa, Moriya (JP); Kentaro Kamae, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/497,054

(22) Filed: Apr. 25, 2017

(65) Prior Publication Data

US 2017/0315462 A1 Nov. 2, 2017

(30) Foreign Application Priority Data

Apr. 28, 2016 (JP) ..... 2016-091437

(51) Int. Cl.

*G03G 9/087* (2006.01)
*G03G 9/093* (2006.01)
*G03G 9/08* (2006.01)

(52) U.S. Cl.

CPC ..... *G03G 9/08726* (2013.01); *G03G 9/0804* (2013.01); *G03G 9/0806* (2013.01); *G03G 9/08702* (2013.01); *G03G 9/08704* (2013.01); *G03G 9/08724* (2013.01); *G03G 9/08728* (2013.01); *G03G 9/08795* (2013.01); *G03G 9/08797* (2013.01); *G03G 9/09321* (2013.01); *G03G 9/08755* (2013.01)

(58) Field of Classification Search

CPC ..... G03G 9/08726; G03G 9/08728; G03G 9/08704; G03G 9/09321; G03G 9/08795; G03G 9/0804

See application file for complete search history.

(56) References Cited

U.S. PATENT DOCUMENTS

| | | | | | |
|---|---|---|---|---|---|
| 4,797,344 | A * | 1/1989 | Nakahara | G03G 9/08728 | 428/402.21 |
| 4,855,207 | A * | 8/1989 | Tsubuko | G03G 9/08704 | 430/108.4 |
| 5,538,828 | A * | 7/1996 | Suzuki | G03G 9/08704 | 430/109.3 |
| 2003/0219665 | A1* | 11/2003 | Matsumura | G03G 9/08711 | 430/108.1 |
| 2014/0030648 | A1* | 1/2014 | Miyamoto | G03G 9/09321 | 430/110.2 |
| 2017/0037229 | A1* | 2/2017 | Tanaka | G03G 9/08711 | |

FOREIGN PATENT DOCUMENTS

| | | | |
|---|---|---|---|
| DE | 2542374 | A1 | 4/1976 |
| JP | 56-13943 | B2 | 4/1981 |
| JP | S57-060341 | A | 4/1982 |
| JP | 58-95750 | A | 6/1983 |
| JP | 59-18954 | A | 1/1984 |
| JP | 62-39428 | B2 | 8/1987 |
| JP | 3-150576 | A | 6/1991 |
| JP | 4-21860 | A | 1/1992 |
| JP | 4-120554 | A | 4/1992 |
| JP | 8-184986 | A | 7/1996 |
| JP | 11-202555 | A | 7/1999 |
| JP | 2011-107261 | A | 6/2011 |

* cited by examiner

*Primary Examiner* — Christopher D RoDee
(74) *Attorney, Agent, or Firm* — Canon U.S.A., Inc. IP Division

(57) ABSTRACT

A toner includes a toner particle containing a resin component. The resin component contains an ester group-containing olefin copolymer and an acid group-containing olefin copolymer. For example, the ester group-containing olefin copolymer is an ethylene-vinyl acetate copolymer, and the acid group-containing olefin copolymer is an ethylene-methacrylic acid copolymer. The acid group-containing olefin copolymer has an acid value of 50 to 300 mg KOH/g. The content of the ester group-containing olefin copolymer in the resin component is 50 mass % or more based on the total mass of the resin component. The content of the unit derived from the vinyl acetate is 3 mass % or more and 35 mass % or less based on the total mass of the ester group-containing olefin copolymer.

10 Claims, No Drawings

TONER

BACKGROUND OF THE INVENTION

Field of the Invention

The present disclosure relates to a toner to be used for electrophotography.

Description of the Related Art

In recent years, attempts for further reducing the fixing temperature of toner in image forming have been tried with an increase in the demand for energy saving. As methods for improving low-temperature fixability, Japanese Patent Publication Nos. 56-13943 and 62-39428 and Japanese Patent Laid-Open No. 4-120554 disclose techniques relating to toner particles containing crystalline polyester resins each having a sharp melt property that greatly reduces the viscosity when the temperature exceeds the melting point.

As other methods, Japanese Patent Laid-Open Nos. 2011-107261, 11-202555, 8-184986, 4-21860, 3-150576, 59-18954, and 58-95750 disclose techniques for reducing the fixing temperature by using toner particles containing resins having low glass transition temperatures. Specifically, these patent publications disclose toners including toner particles containing ester group-containing olefin copolymers, such as ethylene-vinyl acetate copolymers and ethylene-methyl acrylate copolymers, as the resins having low glass transition temperatures.

Toner particles containing a crystalline polyester resin as the resin component have excellent low-temperature fixability due to the sharp melt properties of the crystalline polyester resin.

However, crystalline polyester resins tend to have low volume resistivity and cause a problem in the charge-retaining properties of toners.

Accordingly, the present inventors tried to achieve both low-temperature fixability and charge-retaining properties by using a resin having a high volume resistivity and a low glass transition temperature (not higher than room temperature) as the resin component of toner particles.

However, as disclosed in Japanese Patent Laid-Open Nos. 2011-107261, 11-202555, 8-184986, 4-21860, and 3-150576, toner particles partially containing ester group-containing olefin copolymers were difficult to obtain sufficient low-temperature fixability in high-speed image forming.

In addition, as disclosed in Japanese Patent Laid-Open Nos. 59-18954 and 58-95750, the use of an ester group-containing olefin copolymer as a resin component (main component) of toner particles has a problem of low adhesiveness between the toner (toner image) and paper. In particular, in the case of forming images by an electrophotographic method employing a heat-and-pressure fixing system that applies a low pressure to the toner at fixing, the problem of low adhesiveness between the toner and paper becomes significant. Consequently, if the fixed object after heat-and-pressure fixing is rubbed with an eraser or the like, a problem of detachment of the toner from the paper occurs.

SUMMARY OF THE INVENTION

The present disclosure provides a toner having excellent low-temperature fixability, charge-retaining properties, and adhesiveness to paper.

The present inventors have diligently studied and, as a result, have found that a toner having excellent low-temperature fixability, charge-retaining properties, and adhesiveness to paper can be obtained by using an ester group-containing olefin copolymer as a main resin of the toner particles and also using an acid group-containing olefin copolymer as a resin of the toner particles. An ethylene ester group-containing copolymer and an acid group-containing olefin copolymer have similar chemical structures and thereby have high compatibility with each other. It is therefore presumed that both coexist with each other in a toner particle without causing significant phase separation. It is also presumed that acid groups of an acid group-containing olefin copolymer form hydrogen bonds with hydroxy groups on the surface of paper at fixing. Probably due to these two reasons, the toner expresses high adhesiveness to paper.

That is, the toner of the present disclosure includes a toner particle containing a resin component, wherein the resin component contains:

an ester group-containing olefin copolymer, and an acid group-containing olefin copolymer;

the ester group-containing olefin copolymer includes:

a unit Y1 represented by Formula (1), and a unit Y2 composed of at least one member selected from the group consisting of units represented by Formula (2) and units represented by Formula (3);

the ester group-containing olefin copolymer has an acid value of 10 mg KOH/g or less, and the acid group-containing olefin copolymer has an acid value of 50 mg KOH/g or more and 300 mg KOH/g or less;

the content of the ester group-containing olefin copolymer in the resin component is 50 mass % or more based on the total mass of the resin component; and the content of the unit Y2 in the ester group-containing olefin copolymer is 3 mass % or more and 35 mass % or less based on the total mass of the ester group-containing olefin copolymer, (1)

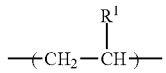

(2)

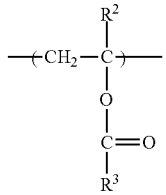

(3)

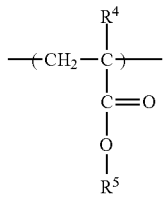

in Formulae (1) to (3), $R^1$ denotes H or $CH_3$; $R^2$ denotes H or $CH_3$; $R^3$ denotes $CH_3$ or $C_2H_5$; $R^4$ denotes H or $CH_3$; and $R^5$ denotes $CH_3$ or $C_2H_5$.

Further features of the present disclosure will become apparent from the following description of exemplary embodiments.

DESCRIPTION OF THE EMBODIMENTS

In the present disclosure, the resin component of toner particles is a polymer component mainly contributing to the fixing ability. The resin component contains an ester group-containing olefin copolymer and an acid group-containing olefin copolymer.

In the present disclosure, the ester group-containing olefin copolymer is a resin (polymer) prepared by introducing an ester group unit into a polyolefin skeleton by a method, such as copolymerization. Specifically, the ester group-containing olefin copolymer includes a unit Y1 represented by Formula (1) and a unit Y2 composed of at least one member selected from the group consisting of units represented by Formula (2) and units represented by Formula (3):

(1)

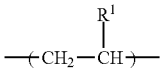

(2)

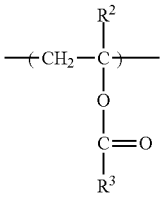

(3)

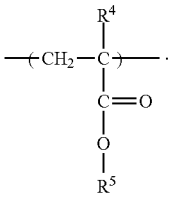

The unit Y2 composed of at least one member selected from the group consisting of units represented by Formula (2) and units represented by Formula (3) will now be specifically described.

An example of the ester group-containing olefin copolymer is a copolymer including a unit represented by Formula (1) wherein $R^1$ denotes H and a unit represented by Formula (2) wherein $R^2$ denotes H and $R^3$ denotes $CH_3$. This copolymer is called ethylene-vinyl acetate copolymer. The ethylene-vinyl acetate copolymer can be designed so as to have a low melting point and can be used from the viewpoint of low-temperature fixability.

Another example of the ester group-containing olefin copolymer is a copolymer including a unit represented by Formula (1) wherein $R^1$ denotes H and a unit represented by Formula (3) wherein $R^4$ denotes H and $R^5$ denotes $CH_3$. This copolymer is called ethylene-methyl acrylate copolymer.

Another example of the ester group-containing olefin copolymer is a copolymer including a unit represented by Formula (1) wherein $R^1$ denotes H and a unit represented by Formula (3) wherein $R^4$ denotes H and $R^5$ denotes $C_2H_5$. This copolymer is called ethylene-ethyl acrylate copolymer.

Another example of the ester group-containing olefin copolymer is a copolymer including a unit represented by Formula (1) wherein $R^1$ denotes H and a unit represented by Formula (3) wherein $R^4$ denotes $CH_3$ and $R^5$ denotes $CH_3$. This copolymer is called ethylene-methyl methacrylate copolymer.

The ethylene-methyl acrylate copolymer, the ethylene-ethyl acrylate copolymer, and the ethylene-methyl methacrylate copolymer have high chemical stability and can be used from the viewpoint of storage of toners under high temperature and high humidity.

The resin component may contain one or more of the ester group-containing olefin copolymers. Herein, the total mass of the ester group-containing olefin copolymers is denoted by W, the mass of the unit represented by Formula (1) is denoted by 1, the mass of the unit represented by Formula (2) is denoted by m, and the mass of the unit represented by Formula (3) is denoted by n. The ratio (l+m+n)/W is preferably 0.80 or more, more preferably 0.95 or more, and most preferably 1.00, from the viewpoint of low-temperature fixability and charge-retaining properties.

Examples of the units other than the unit Y1 and the unit Y2 that may be contained in the ester group-containing olefin copolymer include the unit represented by Formula (4) and the unit represented by Formula (5). These units can be introduced by adding monomers corresponding to these units during the copolymerization for producing the ester group-containing olefin copolymer. Alternatively, these units can be introduced by modifying the ester group-containing olefin copolymer with monomers corresponding to these units by polymer reaction.

(4)

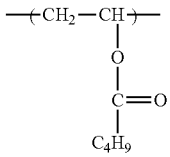

(5)

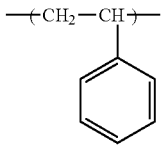

However, acid groups (acidic functional groups) deteriorate the charge-retaining properties of toners. Accordingly, the acid value of the ester group-containing olefin copolymer is 10 mg KOH/g or less, preferably 5 mg KOH/g or less, and more preferably substantially 0 mg KOH/g.

From the viewpoint of the low-temperature fixability of a toner, the ester group-containing olefin copolymer is used as the main resin of the toner particles. Accordingly, the toner particles need to contain the ester group-containing olefin copolymer in an amount of 50 mass % or more, more preferably 70 mass % or more, based on the total mass of the resin component. The ester group-containing olefin copolymer has a glass transition temperature of 0° C. or less and therefore provides good low-temperature fixability by being contained in an amount of 50 mass % or more in the resin component.

The content of the unit Y2 in the ester group-containing olefin copolymer should be 3 mass % or more and 35 mass % or less, preferably 5 mass % or more and 20 mass % or less, based on the total mass of the ester group-containing olefin copolymer from the viewpoint of charge-retaining properties. The charge-retaining properties as a toner are improved by controlling the content of the unit Y2 in the ester group-containing olefin copolymer to 35 mass % or less. On the other hand, the content of the unit Y2 in the ester group-containing olefin copolymer controlled to 3 mass % or more improves the adhesiveness to paper to provide good low-temperature fixability. For example, in the case of an ethylene-vinyl acetate copolymer, the content of the unit derived from vinyl ester in the ethylene-vinyl acetate copolymer can be 3 mass % or more and 35 mass % or less based on the total mass of the ethylene-vinyl acetate copolymer. In the ethylene-vinyl acetate copolymer, the unit derived from vinyl acetate corresponds to the unit Y2. The mass of each unit 1, m, and n and the content of the unit Y2 can be measured by a general analytical method, such as a nuclear magnetic resonance method (NMR) or pyrolysis gas chromatography.

Measurement by $^1$H NMR is performed as follows:

The proportions of the units represented by Formula (1), (2), or (3) can be calculated by comparing the integral values of the hydrogen atoms in the unit represented by Formula (1), the hydrogen atoms in $R^3$ in the unit represented by Formula (2), and the hydrogen atoms in $R^5$ in the unit represented by Formula (3).

For example, in the calculation of the proportion of the unit in the ethylene-vinyl acetate copolymer (the proportion of the unit derived from vinyl acetate: 15 mass %), a solution prepared by dissolving about 5 mg of a sample in 0.5 mL of deuterated acetone containing an internal standard, tetramethylsilane, showing a peak at 0.00 ppm is put in a test tube, and 1H NMR is measured under conditions of a repetition time of 2.7 seconds and a cumulated number of 16 times. The peak of 1.14 to 1.36 ppm corresponds to $CH_2$—$CH_2$ in the unit derived from ethylene; and the peak near 2.04 ppm corresponds to $CH_3$ in the unit derived from vinyl acetate. The proportions of the units can be calculated from the integral values of these peaks.

The ester group-containing olefin copolymer can have a melt flow rate of 5 g/10 min or more and 30 g/10 min or less. A melt flow rate of 30 g/10 min or less can prevent a reduction in the strength as a toner and can prevent the blocking during storage. The melt flow rate can be 20 g/10 min or less from the viewpoint of enduring the impact and the pressure at the time of use of the toner.

The ester group-containing olefin copolymer can have a melt flow rate of 5 g/10 min or more from the viewpoint of the glossiness of images.

The melt flow rate was measured with reference to JIS K 7210 under conditions of a temperature of 190° C. and a load of 2160 g. When the resin component contains a plurality of the ester group-containing olefin copolymers, the melt flow rate was measured after melt mixing under the same conditions as above.

The melt flow rate can be controlled by changing the molecular weight of the ester group-containing olefin copolymer. The melt flow rate decreases with an increase in the molecular weight.

The ester group-containing olefin copolymer preferably has a weight-average molecular weight of 50000 or more and more preferably 100000 or more.

The ester group-containing olefin copolymer should have a weight-average molecular weight of 500000 or less from the viewpoint of the glossiness of images.

The ester group-containing olefin copolymer preferably has a rupture elongation of 300% or more and more preferably 500% or more. A rupture elongation of 300% or more provides good bending resistance to the fixed object.

The rupture elongation was measured under conditions with reference to JIS K 7162. In the resin component containing a plurality of the ester group-containing olefin copolymers, the rupture elongation was measured after melt mixing under the same conditions as above.

The toner particles contain an acid group-containing olefin copolymer having an acid value of 50 mg KOH/g or more and 300 mg KOH/g or less as a resin component. In the toner particles containing an acid group-containing olefin copolymer having an acid value of 50 mg KOH/g or more and 300 mg KOH/g or less, the acid group (for example, carboxy group) of the acid group-containing olefin copolymer forms a hydrogen bond with a hydroxy group on the surface of paper. As a result, the adhesiveness between the toner (toner image) and the paper is enhanced to prevent the fixed object from being deleted by an eraser.

The acid group-containing olefin copolymer includes a unit derived from olefin, such as polyethylene or polypropylene, as a main unit and is also a polymer having a skeleton to which a unit having an acid group is introduced by copolymerization. Examples of the unit having an acid group include acrylic acid, methacrylic acid, maleic acid, maleic anhydride, itaconic acid, and vinyl sulfonate. Examples of the acid group include a carboxy group and a sulfo group.

In addition, the acid group-containing olefin copolymer may contain a unit other than the unit derived from olefin and the unit having an acid group mentioned above within a range not affecting the physical properties. The content of such a unit in the acid group-containing olefin copolymer is preferably 20 mass % or less, more preferably 10 mass % or less, more preferably 5 mass % or less, and most preferably substantially 0 mass %. Furthermore, from the viewpoint of fixability, the acid group-containing olefin copolymer can be a copolymer including a unit derived from ethylene as the main unit (polyethylene as the main component) and further including a unit having an acid group. From the viewpoint of adhesiveness to paper, the unit having an acid group can be a unit derived from acrylic acid or a unit derived from methacrylic acid. That is, from the viewpoint of adhesiveness to paper, the acid group-containing olefin copolymer can be an ethylene-acrylic acid copolymer or an ethylene-methacrylic acid copolymer.

The content of the acid group-containing olefin copolymer is preferably 10 mass % or more and 50 mass % or less, more preferably 10 mass % or more and 30 mass % or less, based on the total mass of the resin component. If the content of the acid group-containing olefin copolymer is less than 10 mass %, the adhesiveness to paper is deteriorated. If the content of the acid group-containing olefin copolymer is higher than 30 mass %, the chargeability highly varies depending on the environment.

The acid group-containing olefin copolymer should have an acid value of 50 mg KOH/g or more and 300 mg KOH/g or less and preferably has an acid value of 80 mg KOH/g or more and 200 mg KOH/g or less. An acid value of 50 mg KOH/g or more expresses sufficient adhesiveness between the toner and paper, and an acid value of 300 mg KOH/g or less improves the chargeability of the toner.

The term "acid value" refers to the number of mg of potassium hydroxide required to neutralize the acid components, such as free fatty acid and resin acid, contained in 1 g of a sample. The acid value is measured in accordance with Japanese Industrial Standard (JIS)-K0070.

(1) Reagent

Solvent: toluene-ethyl alcohol mixture solution (2:1) is neutralized with a 0.1 mol/L potassium hydroxide-ethyl alcohol solution using phenolphthalein as an indicator immediately before the use.

Phenolphthalein solution: 1 g of phenolphthalein is dissolved in 100 mL of ethyl alcohol (95 vol %).

Potassium hydroxide-ethyl alcohol solution (0.1 mol/L): 7.0 g of potassium hydroxide is dissolved in as little water as possible, and ethyl alcohol (95 vol %) is added thereto to make the volume 1 L. The resulting solution is left to stand for 2 to 3 days and is then filtered. The standardization is carried out in accordance with JIS K 8006 (basic items relating to titration during a reagent content test).

(2) Manipulation

As a sample, 1 to 20 g of a resin is precisely weighed, and 100 mL of the solvent and several drops of the phenolphthalein solution as an indicator are added thereto. The mixture is sufficiently shaken to completely dissolve the sample. If the sample is a solid, the mixture is warmed on a water bath to dissolve the sample. After cooling, the solution is titrated with the 0.1 mol/L potassium hydroxide-ethyl alcohol solution, and a slight red color of the indicator continuing for 30 seconds is used as the endpoint of neutralization.

(3) Calculation Expression

The acid value is calculated by the following expression:

$$A=B\times f\times 5.611/S$$

A: acid value (mg KOH/g),

B: the used amount (mL) of 0.1 mol/L potassium hydroxide-ethyl alcohol solution, f: the factor of 0.1 mol/L potassium hydroxide-ethyl alcohol solution, and S: the amount (g) of sample.

The acid group-containing olefin copolymer can have a melt flow rate of 200 g/10 min or less. A melt flow rate of higher than 200 g/10 min has a risk of causing blocking during storage. On the other hand, the melt flow rate of the acid group-containing olefin copolymer can be 10 g/10 min or more from the viewpoint of adhesiveness between the toner and paper. A melt flow rate of less than 10 g/10 min causes a difficulty in the compatibility of the acid group-containing olefin copolymer with the ester group-containing olefin copolymer present in the toner, resulting in a reduction in the adhesiveness of the toner as a whole to paper. The melt flow rate of the acid group-containing olefin copolymer can be measured by the same method as that in the measurement of the melt flow rate of the ester group-containing olefin copolymer.

The acid group-containing olefin copolymer can have a melting point of 50° C. or more and 100° C. or less from the viewpoint of low-temperature fixability and storage stability. A melting point of 100° C. or less further improves the low-temperature fixability. In addition, a melting point of 90° C. or less further improves low-temperature fixability. However, a melting point of less than 50° C. tends to reduce the storage stability.

The melting point of the acid group-containing olefin copolymer can be measured with a differential scanning calorimeter (DSC).

Specifically, 0.01 to 0.02 g of a sample is precisely weighed in an aluminum pan, and the temperature is increased at a heating rate of 10° C./min from 0° C. to 200° C. to obtain a DSC curve.

The peak temperature of the endothermic peak in the resulting DSC curve is defined as the melting point.

In the toner, the acid group-containing olefin copolymer can be present in the surface layer of the toner particle and can be localized in the surface layer compared to the insides of the toner particle.

The presence of the acid group-containing olefin copolymer in the surface layers of the toner particles and the localization in the toner surface layers can be confirmed by a Fourier transform infrared-attenuated total reflection (FT-IR-ATR) method.

In the FT-IR-ATR method, a sample is allowed to adhere to a crystal (ATR crystal) having a refractive index higher than that of the sample, and infrared light is allowed to incident on the crystal at an incident angle of not smaller than the critical angle. Consequently, the incident light is totally reflected at the interface between the adhering sample and the crystal. On this occasion, the infrared light is not reflected at the interface between the sample and the crystal, but slightly penetrates to the sample side and is then totally reflected. The depth of this penetration varies depending on the wavelength, incident angle, and the refractive index of the ATR crystal as follows:

$$dp=\lambda/(2\pi n1)\times[\sin 2\theta-(n1/n2)2]-½$$

dp: depth of penetration, n1: refractive index of sample (in the present disclosure, 1.5), n2: refractive index of ATR crystal (when the ATR crystal is Ge, refractive index: 4.0, and when the ATR crystal is KRS5, refractive index: 2.4), and θ: incident angle.

Accordingly, FT-IR spectra in different depths of penetration can be obtained by changing the refractive index of the ATR crystal or the incident angle.

Specifically, in an FT-IT spectrum measured by the ATR method under conditions of using Ge as the ATR crystal and an infrared light incident angle of 45°, the carboxyl index (Ge) is expressed as follows: carboxyl group (Ge)/(ester group (Ge)+carboxyl group (Ge)), wherein the carboxyl group (Ge) denotes the intensity of the maximum absorption peak in a range of 1680 $cm^{-1}$ or more and 1720 $cm^{-1}$ or less, which is inferred to be derived from the carboxyl group of the acid group-containing olefin copolymer; and the ester group (Ge) denotes the intensity of the maximum absorption peak in a range of 1725 $cm^{-1}$ or more and 1765 $cm^{-1}$ or less, which is inferred to be derived from the ester group of the ester group-containing olefin copolymer. The carboxyl index (Ge) relates to the abundance ratio of the acid group-containing olefin copolymer relative to the binder resin in the region from the toner particle surface to about 0.4 μm depth in the depth direction of the toner particle toward the center of the toner particle from the surface.

The carboxyl index (Ge) is preferably 0.15 or more and 0.40 or less, more preferably 0.20 or more and 0.40 or less, and most preferably 0.25 or more and 0.40 or less. A carboxyl index (Ge) of 0.15 or more enhances the strength of the toner surface by the hydrogen bond between the acid group-containing olefin copolymer molecules. Consequently, the external additive on the surface of the toner particle is prevented from being buried in use for a long time, the adhesive force of the toner does not increase, and stable images can be formed. In addition, a carboxyl index (Ge) of 0.15 or more allows the acid group-containing olefin copolymer on the toner particle surface to form a hydrogen bond with paper at fixing. In addition, a carboxyl index (Ge) of 0.4 or less can provide good charge-retaining properties under high humidity environment.

The carboxyl index (D) is determined as in the carboxyl index (Ge) except that diamond/KRS5 is used as the ATR crystal. The carboxyl index (D) is expressed as follows: carboxyl group (D)/(ester group (D)+carboxyl group (D)), wherein the carboxyl group (D) denotes the intensity of the maximum absorption peak in a range of 1680 $cm^{-1}$ or more and 1720 $cm^{-1}$ or less, which is inferred to be derived from the carboxyl group of the acid group-containing olefin copolymer; and the ester group (D) denotes the intensity of the maximum absorption peak in a range of 1725 $cm^{-1}$ or more and 1765 $cm^{-1}$ or less, which is inferred to be derived from the ester group of the ester group-containing olefin copolymer. The carboxyl index (D) relates to the abundance ratio of the acid group-containing olefin copolymer relative to the binder resin in the region from the toner particle surface to about 1.2 μm depth in the depth direction of the toner particle toward the center of the toner particle from the surface. The carboxyl index (Ge) indicates the degree of quantity of the acid group-containing olefin copolymer in the vicinity of the surface of the toner particle, and the carboxyl index (D) indicates the degree of quantity of the acid group-containing olefin copolymer in the toner particle including the inside thereof. The ratio, carboxyl index (Ge)/carboxyl index (D), is a value indicating the degree of localization of the acid group-containing olefin copolymer to the surface in a toner particle and is preferably 1.2 or more and 2.4 or less and more preferably 1.4 or more and 2.4 or less. If the value of carboxyl index (Ge)/carboxyl index (D) is less than 1.2, the acid group-containing olefin copolymer is not localized to the toner surface, which causes a necessity of adding a large amount of an acid group-containing olefin copolymer having a high strength and deteriorates the low-temperature fixability.

If the value of carboxyl index (Ge)/carboxyl index (D) is higher than 2.4, the degree of localization of the acid group-containing olefin copolymer to the toner surface is too high, which reduces the compatibility with the ester group-containing olefin copolymer forming the inside of the toner and deteriorates the low-temperature fixability.

A value of carboxyl index (Ge)/carboxyl index (D) of 2.4 or less improves the low-temperature fixability.

The carboxyl index (Ge) and the carboxyl index (D) can be measured by the following method.

The FT-IR spectrum is measured by an ATR method with a Fourier transform infrared spectrometer (Spectrum One: manufactured by PerkinElmer, Inc.) equipped with a universal ATR sampling accessory. A specific procedure of the measurement is as follows. The incident angle of infrared light is set to 450. The ATR crystal of Ge (refractive index: 4.0) and the ATR crystal of diamond/KRS5 (refractive index: 2.4) are used. Other conditions are as follows.

Range

Start: 4000 $cm^{-1}$

End: 600 $cm^{-1}$ (ATR crystal of Ge), 400 $cm^{-1}$ (ATR crystal of KRS5)

Duration

Scan number: 16

Resolution: 4.00 $cm^{-1}$

Advanced: $CO_2/H_2O$ correction

Method of Measuring and Calculating Carboxyl Index (Ge)

(1) The ATR crystal of Ge (refractive index: 4.0) is set to the apparatus.

(2) The Scan type and the Units are set to Background and EGY, respectively, and the background is measured.

(3) The Scan type is set to Sample, and the Units is set to A.

(4) 0.01 g of toner particles is precisely weighed on the ATR crystal.

(5) The sample is pressed with a pressure arm (Force Gauge: 90).

(6) The FT-IR spectrum of the sample is measured.

(7) The baseline of the resulting FT-IR spectrum is corrected by Automatic Correction.

(8) The maximum absorption peak intensity in a range of 1680 $cm^{-1}$ or more and 1720 $cm^{-1}$ or less is calculated as the carboxyl group (Ge).

(9) The maximum absorption peak intensity in a range of 1725 $cm^{-1}$ or more and 1765 $cm^{-1}$ or less is calculated as the ester group (Ge).

(10) The value of carboxyl group (Ge)/(ester group (Ge)+carboxyl group (Ge)) is defined as the carboxyl index (Ge).

Method of Measuring and Calculating Carboxyl Index (D)

(1) The ATR crystal of diamond/KRS5 (refractive index: 2.4) is set to the apparatus.

(2) The Scan type and the Units are set to Background and EGY, respectively, and the background is measured.

(3) The Scan type is set to Sample, and the Units is set to A.

(4) 0.01 g of toner particles is precisely weighed on the ATR crystal.

(5) The sample is pressed with a pressure arm (Force Gauge: 90).

(6) The FT-IR spectrum of the sample is measured.

(7) The baseline of the resulting FT-IR spectrum is corrected by Automatic Correction.

(8) The maximum absorption peak intensity in a range of 1680 $cm^{-1}$ or more and 1720 $cm^{-1}$ or less is calculated as the carboxyl group (D).

(9) The maximum absorption peak intensity in a range of 1725 $cm^{-1}$ or more and 1765 $cm^{-1}$ or less is calculated as the ester group (D).

(10) The value of carboxyl group (D)/(ester group (D)+carboxyl group (D)) is defined as the carboxyl index (D).

The toner particle of the toner may further contain another polymer as the resin component, in addition to the ester group-containing olefin copolymer and the acid group-containing olefin copolymer. Specifically, examples of such polymers include homopolymers of styrene and its substitutes, such as polystyrene, poly-p-chlorostyrene, and polyvinyltoluene; styrenic copolymers, such as a styrene-p-chlorostyrene copolymer, a styrene-vinyltoluene copolymer, a styrene-vinylnaphthalene copolymer, a styrene-acrylate copolymer, and a styrene-methacrylate copolymer; poly(vinyl chloride); phenolic resins; natural modified phenolic resins; natural resin modified maleic acid resins; acrylic resins; methacrylic resins; poly(vinyl acetate); silicone resins; polyester resins; polyurethane; polyamide resins; furan resins; epoxy resins; xylene resins; polyethylene resins; and polypropylene resins.

The toner particle of the toner can contain an aliphatic hydrocarbon compound having a melting point of 50° C. or more and 100° C. or less in an amount of 1 part by mass or more and 40 parts by mass or less based on 100 parts by mass of the resin component.

The toner particle of the toner can contain an aliphatic hydrocarbon compound.

The aliphatic hydrocarbon compound can plasticize the ester group-containing olefin copolymer by being heated. Accordingly, the ester group-containing olefin copolymer that forms a matrix at heat fixing of the toner is plasticized by adding the aliphatic hydrocarbon compound to the toner particles, resulting in enhancement of the low-temperature fixability. Furthermore, the aliphatic hydrocarbon compound having a melting point of 50° C. or more and 100° C. or less also functions as a nucleating agent of the ester group-containing olefin copolymer. Accordingly, the micromobility of the ester group-containing olefin copolymer is suppressed to improve the chargeability. The content of the aliphatic hydrocarbon compound can be 10 parts by mass or more and 30 parts by mass or less based on 100 parts by mass of the resin component, from the viewpoint of low-temperature fixability and chargeability.

The melting point of the aliphatic hydrocarbon compound can be determined by the same method as that for measuring the melting point of the acid group-containing olefin copolymer.

Examples of the aliphatic hydrocarbon compound include saturated hydrocarbons having 20 to 60 carbon atoms, such as hexacosane, triacontane, and hexatriacontane.

The toner particle of the toner can contain silicone oil as a release agent, whereas the release agents that are usually used in toners, such as alkyl waxes, are highly compatible with the ester group-containing olefin copolymer and hardly achieve the releasing effect. In addition, the addition of silicone oil enhances the dispersibility of the pigment in the toner particle and allows to readily form high density images.

Examples of the silicone oil include dimethyl silicone oil, methyl phenyl silicone oil, methyl hydrogen silicone oil, amino-modified silicone oil, carboxy-modified silicone oil, alkyl-modified silicone oil, and fluorine-modified silicone oil. The silicone oil preferably has a kinematic viscosity of 5 $mm^2/s$ or more and 1000 $mm^2/s$ or less and more preferably 20 $mm^2/s$ or more and 1000 $mm^2/s$ or less.

The amount of the silicone oil is preferably 1 part by mass or more and 20 parts by mass or less, more preferably 5 parts by mass or more and 20 parts by mass or less, based on 100 parts by mass of the resin component, from the point of achieving good releasability while preventing a reduction in flowability.

The toner may contain a coloring agent. Examples of the coloring agent include the followings.

Examples of black coloring agents include carbon black; and coloring agents toned to black using yellow coloring agents, magenta coloring agents, and cyan coloring agents. The coloring agents may be pigments only, but combinations of dyes and pigments can enhance the definition to form high-quality full-color images.

Examples of pigments for magenta toners include C.I. Pigment Reds 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, and 282; C.I. Pigment Violet 19; and C.I. Vat Reds 1, 2, 10, 13, 15, 23, 29, and 35.

Examples of dyes for magenta toners include oil-soluble dyes, such as C.I. Solvent Reds 1, 3, 8, 23, 24, 25, 27, 30, 49, 81, 82, 83, 84, 100, 109, and 121; C.I. Disperse Red 9; C.I. Solvent Violets 8, 13, 14, 21, and 27; and C.I. Disperse Violet 1, and include basic dyes, such as C.I. Basic Reds 1, 2, 9, 12, 13, 14, 15, 17, 18, 22, 23, 24, 27, 29, 32, 34, 35, 36, 37, 38, 39, and 40; and C.I. Basic Violets 1, 3, 7, 10, 14, 15, 21, 25, 26, 27, and 28.

Examples of pigments for cyan toners include C.I. Pigment Blues 2, 3, 15:2, 15:3, 15:4, 16, and 17; C.I. Vat Blue 6; C.I. Acid Blue 45; and copper phthalocyanine pigments having phthalocyanine skeletons substituted with one to five phthalimide methyl groups.

Examples of dyes for cyan toners include C.I. Solvent Blue 70.

Examples of pigments for yellow toners include C.I. Pigment Yellows 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185; and C.I. Vat Yellows 1, 3, and 20.

Examples of dyes for yellow toners include C.I. Solvent Yellow 162.

These coloring agents may be used alone or as a mixture and can be used in a form of a solid solution. The coloring agent is selected from the points of hue angle, color saturation, brightness, light resistance, OHP transparency, and dispersibility in the toner.

The content of the coloring agent can be 1 part by mass or more and 20 parts by mass or less based on 100 parts by mass of the resin component.

The toner preferably has a volume median diameter of 3.0 μm or more and 10.0 μm or less, more preferably 4.0 μm or more and 7.0 μm or less, from the viewpoint of forming high-definition images.

A method of producing a toner will be described. Although the toner may be produced by any appropriate method, the toner can be produced as an emulsion aggregation toner produced by an emulsion aggregation process described below, because the acid group (for example, carboxy group) contained in the acid group-containing olefin copolymer is readily present on the surfaces of emulsified particles and aggregation can be readily controlled to give a sharp particle size distribution. In addition, the acid group contained in the acid group-containing olefin copolymer is readily present in the surfaces of the toner particles, which further easily causes localization.

The emulsion aggregation process is a method of producing toner particles by preparing in advance a dispersion of resin fine particles sufficiently small for the target particle diameter and aggregating the resin fine particles in an aqueous medium.

In the emulsion aggregation process, the toner is produced through a step (1) of producing resin fine particles by emulsification, a step (2) of aggregating the resin fine particles to produce aggregated particles, and a step (3) of fusing the aggregated particles. In addition, a shell-forming step is optionally performed after the step (2) or the step (3). Furthermore, a cooling step and a washing step are optionally performed after the step (3).

A method of producing a toner using the emulsion aggregation process will now be specifically described, but the present invention is not limited thereto.

Step (1): Production of Resin Fine Particles

In the emulsion aggregation process, resin fine particles are first prepared. The resin fine particles can be produced by a known method, but can be produced by the following method.

The ester group-containing olefin copolymer and the acid group-containing olefin copolymer are dissolved in an organic solvent to form a uniform solution. A basic compound and an optional surfactant are then added to the solution. In the presence of a surfactant, an aqueous solvent is further added to the solution to form fine particles. Lastly, the solvent is removed. Thus, a resin fine particle dispersion in which resin particles are dispersed can be produced. When the resin fine particles of the ester group-containing olefin copolymer and the acid group-containing olefin copolymer are formed by co-emulsification, the ester group-containing olefin copolymer and the acid group-containing olefin copolymer are mixed with each other in the atomized organic phase in the fine particles to increase the compatibility in the toner, resulting in enhancement of adhesiveness between the toner and paper. More specifically, the ester group-containing olefin copolymer and the acid group-containing olefin copolymer are dissolved with heating in an organic solvent, and a surfactant and a base are added thereto.

Subsequently, in the presence of a surfactant, an aqueous solvent is gradually added to the solution with applying shear with, for example, a homogenizer to produce a resin-containing co-emulsion (resin fine particle dispersion). Alternatively, after addition of the aqueous solvent, shear is applied with, for example, a homogenizer to produce a resin-containing co-emulsion. Subsequently, the solvent is removed by heating or reducing the pressure to produce a resin fine particle-containing co-emulsion (resin fine particle dispersion).

The concentration of the resin component to be dissolved in an organic solvent is preferably 10 mass % or more and 50 mass % or less, more preferably 30 mass % or more and 50 mass % or less, based on 100 mass % of the organic solvent. The organic solvent used for dissolving may be any solvent that can dissolve the resin and can be a solvent having a high solubility for the ester group-containing olefin copolymer, such as toluene, xylene, and ethyl acetate.

The surfactant to be used in the emulsification may be any surfactant. Examples of the surfactant include anionic surfactants, such as sulfate, sulfonate, carboxylate, phosphate, and soap anionic surfactants; cationic surfactants, such as amine salt and quaternary ammonium salt cationic surfactants; and nonionic surfactants, such as polyethylene glycol, alkylphenol-ethylene oxide adduct, and polyhydric alcohol nonionic surfactants.

Examples of the base to be used in the emulsification include inorganic bases, such as sodium hydroxide and potassium hydroxide; and organic bases, such as triethylamine, trimethylamine, dimethylaminoethanol, and diethylaminoethanol. The bases may be used alone or in combination of two or more thereof.

The resin fine particles preferably have a volume median diameter of 0.05 μm or more and 1.0 μm or less and more preferably 0.1 μm or more and 0.6 μm or less. When the median diameter is within this range, toner particles having a desired particle diameter can be readily prepared. The volume median diameter can be measured with a dynamic light scattering particle size analyzer (Nanotrac UPA-EX150: manufactured by Nikkiso Co., Ltd.).

Step (2): Production of Aggregated Particles

In the step (2) of producing aggregated particles, the resin fine particle dispersion prepared above is mixed with a coloring agent fine particle dispersion and a release agent fine particle dispersion to prepare a mixture solution. The particles contained in the prepared mixture solution are then aggregated to form aggregated particles. The aggregated particles are formed by, for example, adding a flocculant to the mixture solution and mixing and heating or appropriately applying a mechanical power or the like to the mixture solution.

The coloring agent fine particle dispersion to be used in the step (2) is prepared by dispersing the above-mentioned coloring agent. The coloring agent fine particles are dispersed by a known method, for example, using a rotational shear-type homogenizer, a media-type disperser, such as a ball mill, sand mill, or attritor, or a high-pressure counter collision-type disperser. In addition, a surfactant or polymer dispersant for providing dispersion stability can be optionally added to the dispersion.

The release agent fine particle dispersion to be used in the step (2) is prepared by dispersing the above-mentioned release agent in an aqueous solvent. The release agent is dispersed by a known method, for example, using a rotational shear-type homogenizer, a media-type disperser, such as a ball mill, sand mill, or attritor, or a high-pressure counter collision-type disperser. In addition, a surfactant or polymer dispersant for providing dispersion stability can be optionally added to the dispersion.

Examples of the flocculant used in the step (2) include salts of monovalent metals such as sodium and potassium; salts of divalent metals such as calcium and magnesium; salts of trivalent metals such as iron and aluminum; and polyvalent metal salts, such as polychlorinated aluminum. From the viewpoint of particle diameter controllability of the step (2), particularly, divalent metal salts, such as calcium chloride and magnesium sulfate, can be used.

Addition and mixing of the flocculant can be performed in a temperature range of room temperature to 75° C. By performing mixing under this temperature condition, the aggregation stably progresses. The mixing can be performed with, for example, a known mixing apparatus, homogenizer, or mixer.

The aggregated particles formed in the step (2) may have any average particle diameter and is generally controlled to 4.0 μm or more and 7.0 μm or less so as to have the same average particle diameter as that of target toner particles. The particle diameter can be readily controlled by, for example, appropriately setting and changing the temperature at the time of addition and mixing of the flocculant and other agents and the conditions for mixing by stirring. The particle size distribution of the toner particles can be measured by a Coulter method with a particle size distribution analyzer (Coulter Multisizer III: manufactured by Coulter Corporation).

Step (3): Production of Toner Particle

In the step (3) of producing toner particles, the aggregated particles prepared above are heated to a temperature not lower than the melting point of the ester group-containing olefin copolymer for fusing to produce particles having smoothened surfaces from the aggregated particles. Before the step (3), a chelating agent, a pH adjuster, a surfactant, and other additives can be appropriately added to the aggregated particle solution in order to prevent melt-adhesion between toner particles.

Examples of the chelating agent include ethylenediaminetetraacetic acid (EDTA) and its alkali metal salts, such as Na salts, sodium gluconate, sodium tartrate, potassium citrate, sodium citrate, nitrotriacetate (NTA) salts, and many water-soluble polymers (high-polymer electrolytes) containing both of COOH and OH functional groups.

The heating may be carried out at any temperature within a range of not lower than the melting point of the ester group-containing olefin copolymer contained in the aggregated particles to the temperature causing pyrolysis of the ester group-containing olefin copolymer or the acid group-containing olefin copolymer. The time of the heating for fusing is short when the heating temperature is high and is long when the heating temperature is low. That is, the time of the heating for fusing varies depending on the heating temperature and cannot be uniformly defined, but is generally 10 minutes or more and 10 hours or less. In addition, since the acid group-containing olefin copolymer can be localized in the surface, the heating can be carried out at a temperature not lower than the melting point of the acid group-containing olefin copolymer. The acid group-containing olefin copolymer having high hydrophilicity spontaneously localizes in the surface by heating at a temperature not lower than the melting point of the acid group-containing olefin copolymer.

Shell-Forming Step

After the completion of the step (2) or the step (3), a shell-forming step may be performed. In the shell-forming step, resin fine particles forming a shell are added, and an additional flocculant is optionally added. The amount of the acid group-containing olefin copolymer contained in the fine particle to be used in the shell can be higher than that in the fine particle to be used in the core for localizing the acid group-containing olefin copolymer in the surface of the toner particle. The content of the acid group-containing olefin copolymer in the fine particle forming the shell is 20 mass % or more and 60 mass % or less and can be higher than the content of the acid group-containing olefin copolymer in the fine particle forming the core by 10 mass % or more.

Cooling Step

In the cooling step, the aqueous solvent containing the particles is cooled to a temperature lower than the crystallization temperature of the ester group-containing olefin copolymer. If the temperature is not cooled to a temperature lower than the crystallization temperature, coarse particles are generated. Specifically, the cooling rate is 0.1° C./min or more and 50° C./min or less.

In addition, annealing for accelerating crystallization can be performed during the cooling or after the cooling by maintaining the ester group-containing olefin copolymer to a temperature giving a high crystallization speed. The crystallization is accelerated by maintaining a temperature of 30° C. or more and 70° C. or less to improve the blocking property during storage of the toner.

Washing Step

The particles produced through the steps described above are repeatedly washed and filtrated to remove the impurities in the toner particles. Specifically, the toner particles can be washed with an aqueous solution containing a chelating agent, such as ethylenediaminetetraacetic acid (EDTA) or its sodium salt, and further with pure water. In the washing with pure water, the metal salts, surfactants, and other impurities in the toner particles can be removed by repeating filtration several times. The number of times of filtration is preferably 3 times or more and 20 times or less, more preferably 3 times or more and 10 times or less, from the point of manufacturing efficiency.

Drying Step

The particles prepared through the steps described above may be dried, and optionally, inorganic particles, such as silica, alumina, titania, or calcium carbonate, or resin particles, such as vinyl resin, polyester resin, or silicone resin particles, may be added to the particles with applying a shearing force in a dry state. These inorganic particles and resin particles function as external additives, such as a mobile auxiliary and a cleaning auxiliary.

EXAMPLES

The present disclosure will now be described in further detail by Examples and Comparative Examples, which are not intended to limit the invention. Note that the terms "part(s)" and "%" in Examples and Comparative Examples are based on mass, unless otherwise specified.

Production of Resin Fine Particle 1 Dispersion

The following materials:

toluene (manufactured by Wako Pure Chemical Industries, Ltd.): 300 g, ethylene-vinyl acetate copolymer EVA-A (in Formulae (1) and (2), $R^1$ and $R^2$ each denote H, and $R^3$ denotes $CH_3$; the content of the unit represented by Formula (2): 15 mass % based on the total mass of ethylene-vinyl acetate copolymer EVA-A; acid value: 0 mg KOH/g; weight-average molecular weight: 110000; melt flow rate: 12 g/10 min; melting point: 86° C.; rupture elongation: 700%; (l+m+n)/W: 1.00): 100 g, and acid group-containing olefin copolymer A (ethylene-methacrylic acid copolymer; melt flow rate: 60 g/10 min; melting point: 90° C.; acid value: 90 mg KOH/g): 25 g were mixed and dissolved at 90° C.

Separately, 0.7 g of sodium dodecylbenzenesulfonate, 1.5 g of sodium laurate, and 0.8 g of N,N-dimethylaminoethanol were added to 700 g of deionized water and were dissolved with heating at 90° C. Subsequently, this aqueous solution was mixed with the toluene solution prepared above. The mixture was stirred at 7000 rpm with an ultrahigh-speed stirring device T.K. Robomix (manufactured by Primix Corporation) and was further dispersed with a high-pressure impact disperser Nanomizer (manufactured by Yoshida Kikai Co., Ltd.) at a pressure of 200 MPa to produce an emulsion. Subsequently, the toluene was removed with an evaporator, and the concentration was adjusted with deionized water to obtain an aqueous dispersion (resin fine particle 1 dispersion) having a resin fine particle 1 concentration of 20%.

The resin fine particle 1 had a volume median diameter of 0.40 μm measured with a dynamic light scattering particle size analyzer (Nanotrac, manufactured by Nikkiso Co., Ltd.).

Production of Resin Fine Particle 2 Dispersion

A resin fine particle 2 dispersion was obtained in the same manner as that for the resin fine particle 1 dispersion except that the amount of acid group-containing olefin copolymer A was 11 g and the amount of N,N-dimethylaminoethanol was 0.5 g. The resulting resin fine particle 2 had a volume median diameter of 0.48 μm.

Production of Resin Fine Particle 3 Dispersion

A resin fine particle 3 dispersion was obtained in the same manner as that for the resin fine particle 1 dispersion except that the amount of acid group-containing olefin copolymer A was 43 g and the amount of N,N-dimethylaminoethanol was 1.6 g. The resulting resin fine particle 3 had a volume median diameter of 0.33 μm.

Production of Resin Fine Particle 4 Dispersion

A resin fine particle 4 dispersion was obtained in the same manner as that for the resin fine particle 1 dispersion except that ethylene-vinyl acetate copolymer EVA-A was replaced with ethylene-vinyl acetate copolymer EVA-B (in Formulae (1) and (2), $R^1$ and $R^2$ each denote H, and $R^3$ denotes $CH_3$; the content of the unit represented by Formula (2): 20 mass % based on the total mass of ethylene-vinyl acetate copolymer EVA-B; acid value: 0 mg KOH/g; melt flow rate: 14 g/10 min; melting point: 75° C.; rupture elongation: 800%; (l+m+n)/W: 1.00). The resulting resin fine particle 4 had a volume median diameter of 0.45 μm.

Production of Resin Fine Particle 5 Dispersion

A resin fine particle 5 dispersion was obtained in the same manner as that for the resin fine particle 1 dispersion except that ethylene-vinyl acetate copolymer EVA-A was replaced with ethylene-vinyl acetate copolymer EVA-C (in Formulae (1) and (2), $R^1$ and $R^2$ each denote H, and $R^3$ denotes $CH_3$; the content of the unit represented by Formula (2): 28 mass % based on the total mass of ethylene-vinyl acetate copolymer EVA-C; acid value: 0 mg KOH/g; melt flow rate: 20 g/10 min; melting point: 69° C.; rupture elongation: 800%; (l+m+n)/W: 1.00). The resulting resin fine particle 5 had a volume median diameter of 0.50 μm.

Production of Resin Fine Particle 6 Dispersion

A resin fine particle 6 dispersion was obtained in the same manner as that for the resin fine particle 1 dispersion except that ethylene-vinyl acetate copolymer EVA-A was replaced with ethylene-vinyl acetate copolymer EVA-D (in Formulae (1) and (2), $R^1$ and $R^2$ each denote H, and $R^3$ denotes $CH_3$; the content of the unit represented by Formula (2): 6 mass % based on the total mass of ethylene-vinyl acetate copolymer EVA-D; acid value: 0 mg KOH/g; melt flow rate: 75 g/10 min; melting point: 96° C.; rupture elongation: 460%; (l+m+n)/W: 1.00). The resulting resin fine particle 6 had a volume median diameter of 0.45 μm.

Production of Resin Fine Particle 7 Dispersion

A resin fine particle 7 dispersion was obtained in the same manner as that for the resin fine particle 1 dispersion except that acid group-containing olefin copolymer A was replaced with acid group-containing olefin copolymer B (ethylene-methacrylic acid copolymer, melt flow rate: 500 g/10 min, melting point: 95° C., acid value: 60 mg KOH/g). The resulting resin fine particle 7 had a volume median diameter of 0.40 μm.

Production of Resin Fine Particle 8 Dispersion

A resin fine particle 8 dispersion was obtained in the same manner as that for the resin fine particle 1 dispersion except that ethylene-vinyl acetate copolymer EVA-A was replaced with ethylene-ethyl acrylate copolymer EEA-A (in Formulae (1) and (3), $R^1$ and $R^4$ each denote H, and $R^5$ denotes $C_2H_5$; the content of the unit represented by Formula (3): 25 mass % based on the total mass of the ethylene-ethyl acrylate copolymer EEA-A; acid value: 0 mg KOH/g; melt flow rate: 20 g/10 min; melting point: 91° C., rupture elongation: 900%, (l+m+n)/W: 1.00). The resulting resin fine particle 8 had a volume median diameter of 0.41 μm.

Production of Resin Fine Particle 9 Dispersion

A resin fine particle 9 dispersion was obtained in the same manner as that for the resin fine particle 1 dispersion except that ethylene-vinyl acetate copolymer EVA-A was replaced with ethylene-methyl acrylate copolymer EMA-A (in Formulae (1) and (3), $R^1$ and $R^4$ each denote H, and $R^5$ denotes $CH_3$; the content of the unit represented by Formula (3): 14 mass % based on the total mass of the ethylene-methyl acrylate copolymer EMA-A; acid value: 0 mg KOH/g; melt flow rate: 14 g/10 min; melting point: 87° C., rupture elongation: 800%, (l+m+n)/W: 1.00). The resulting resin fine particle 9 had a volume median diameter of 0.46 μm.

Production of Resin Fine Particle 10 Dispersion

A resin fine particle 10 dispersion was obtained in the same manner as that for the resin fine particle 1 dispersion except that ethylene-vinyl acetate copolymer EVA-A was replaced with ethylene-methyl methacrylate copolymer EMMA-A (in Formulae (1) and (3), $R^1$ denotes H, and $R^4$ and $R^5$ each denote $CH_3$; the content of the unit represented by Formula (3): 18 mass % based on the total mass of ethylene-methyl methacrylate copolymer EMMA-A; acid value: 0 mg KOH/g; melt flow rate: 7 g/10 min, melting point: 89° C., rupture elongation: 750%, (l+m+n)/W: 1.00). The resulting resin fine particle 10 had a volume median diameter of 0.44 μm.

Production of Resin Fine Particle 11 Dispersion

A resin fine particle 11 dispersion was obtained in the same manner as that for the resin fine particle 1 dispersion except that ethylene-vinyl acetate copolymer EVA-A was replaced with ethylene-vinyl acetate-vinyl valerate copolymer EVA-E (in Formulae (1) and (2), $R^1$ and $R^2$ each denote H, and $R^3$ denotes $CH_3$; the content of the unit represented by Formula (2): 14 mass % based on the total mass of ethylene-vinyl acetate-vinyl valerate copolymer EVA-E; the proportion of the unit (Formula (4)) derived from vinyl valerate: 6 mass %; acid value: 0 mg KOH/g; melt flow rate: 14 g/10 min, melting point: 83° C., rupture elongation: 750%; (l+m+n)/W: 0.94). The resulting resin fine particle 11 had a volume median diameter of 0.42 μm.

Production of Resin Fine Particle 12 Dispersion

A resin fine particle 12 dispersion was obtained in the same manner as that for the resin fine particle 1 dispersion except that acid group-containing olefin copolymer A was replaced with acid group-containing olefin copolymer C (ethylene-methacrylic acid copolymer, melt flow rate: 130 g/10 min, melting point: 90° C., acid value: 12 mg KOH/g). The resulting resin fine particle 12 had a volume median diameter of 0.51 μm.

Production of Resin Fine Particle 13 Dispersion

A resin fine particle 13 dispersion was obtained in the same manner as that for the resin fine particle 1 dispersion except that acid group-containing olefin copolymer A was replaced with acid group-containing olefin copolymer D (ethylene-methacrylic acid copolymer, melt flow rate: 33 g/10 min, melting point: 88° C., acid value: 30 mg KOH/g). The resulting resin fine particle 13 had a volume median diameter of 0.47 μm.

Production of Resin Fine Particle 14 Dispersion

A resin fine particle 14 dispersion was obtained in the same manner as that for the resin fine particle 1 dispersion except that ethylene-vinyl acetate copolymer EVA-A was replaced with ethylene-vinyl acetate copolymer EVA-F (in Formulae (1) and (2), $R^1$ and $R^2$ each denote H, and $R^3$ denotes $CH_3$; the content of the unit represented by Formula (2): 2 mass % based on the total mass of ethylene-vinyl acetate copolymer EVA-F; acid value: 0 mg KOH/g; melt flow rate: 3 g/10 min; melting point: 105° C.; rupture elongation: 600%, (l+m+n)/W: 1.00). The resulting resin fine particle 14 had a volume median diameter of 0.53 μm.

Production of Resin Fine Particle 15 Dispersion

A resin fine particle 15 dispersion was obtained in the same manner as that for the resin fine particle 1 dispersion except that ethylene-vinyl acetate copolymer EVA-A was replaced with ethylene-vinyl acetate copolymer EVA-G (in Formulae (1) and (2), $R^1$ and $R^2$ each denote H, and $R^3$ denotes $CH_3$; the content of the unit represented by Formula (2): 41 mass % based on the total mass of ethylene-vinyl acetate copolymer EVA-G; acid value: 0 mg KOH/g; melt flow rate: 2 g/10 min; melting point: 40° C.; rupture elongation: 870%; (l+m+n)/W: 1.00). The resulting resin fine particle 15 had a volume median diameter of 0.53 μm.

Production of Resin Fine Particle 16 Dispersion

A resin fine particle 16 dispersion was obtained in the same manner as that for the resin fine particle 1 dispersion except that ethylene-vinyl acetate copolymer EVA-A was replaced with ethylene-vinyl acetate copolymer EVA-H (in Formulae (1) and (2), $R^1$ and $R^2$ each denote H, and $R^3$ denotes $CH_3$; the content of the unit represented by Formula (2): 20 mass % based on the total mass of ethylene-vinyl acetate copolymer EVA-H; acid value: 0 mg KOH/g; melt flow rate: 200 g/10 min; melting point: 75° C.; rupture elongation: 210%; (l+m+n)/W: 1.00). The resulting resin fine particle 16 had a volume median diameter of 0.22 μm.

Production of Resin Fine Particle 17 Dispersion

A resin fine particle 17 dispersion was obtained in the same manner as that for the resin fine particle 1 dispersion except that acid group-containing olefin copolymer A was not used. The resulting resin fine particle 17 had a volume median diameter of 5.51 μm.

Production of Resin Fine Particle 18 Dispersion

A resin fine particle 18 dispersion was obtained in the same manner as that for the resin fine particle 1 dispersion except that ethylene-vinyl acetate copolymer EVA-A was replaced with ethylene-ethyl acrylate copolymer EEA-A and acid group-containing olefin copolymer A was not used. The resulting resin fine particle 18 had a volume median diameter of 6.21 μm.

Production of Resin Fine Particle 19 Dispersion

A resin fine particle 19 dispersion was obtained in the same manner as that for the resin fine particle 1 dispersion except that ethylene-vinyl acetate copolymer EVA-A was replaced with polyester resin A (composition (molar ratio): polyoxypropylene(2.2)-2,2-bis(4-hydroxyphenyl)propane: isophthalic acid:terephthalic acid=100:50:50, number-average molecular weight (Mn): 4600, weight-average molecular weight (Mw): 16500, peak molecular weight (Mp): 10400, glass transition temperature (Tg): 70° C., acid value: 13 mg KOH/g). The resulting resin fine particle 19 had a volume median diameter of 0.22 μm.

Production of Resin Fine Particle 20 Dispersion

A resin fine particle 20 dispersion was obtained in the same manner as that for the resin fine particle 1 dispersion except that ethylene-vinyl acetate copolymer EVA-A and acid group-containing olefin copolymer A were not used and 125 g of crystalline polyester resin A (composition (molar ratio): 1,9-nonanediol: sebacic acid=100:100), number-average molecular weight (Mn): 5500, weight-average molecular weight (Mw): 15500, peak molecular weight (Mp): 11400, melting point: 72° C., acid value: 13 mg KOH/g) was used. The resulting resin fine particle 20 had a volume median diameter of 0.25 μm.

Production of Resin Fine Particle 21 Dispersion

A resin fine particle 21 dispersion was obtained in the same manner as that for the resin fine particle 1 dispersion except that the amount of acid group-containing olefin copolymer A was 100 g and the amount of N,N-dimethylaminoethanol was 3.2 g. The resulting resin fine particle 21 had a volume median diameter of 0.26 μm.

Production of Coloring Agent Fine Particle Dispersion

The following materials: a coloring agent (cyan pigment manufactured by Dainichiseika Color & Chemicals Mfg. Co., Ltd.: Pigment Blue 15:3): 100 parts by mass, an anionic surfactant (manufactured by DKS Co., Ltd.: NeoGen RK): 1.5 parts by mass, and deionized water: 88.5 parts by mass were mixed and dissolved, followed by dispersion of the coloring agent with a high-pressure impact disperser Nanomizer (manufactured by Yoshida Kikai Co., Ltd.) for about 1 hour to prepare an aqueous dispersion (coloring agent fine particle dispersion) having a coloring agent particle concentration of 10%. The resulting coloring agent fine particle had a volume median diameter of 0.20 μm measured with a dynamic light scattering particle size analyzer (Nanotrac, manufactured by Nikkiso Co., Ltd.). Production of aliphatic hydrocarbon compound fine particle dispersion The following materials:

an aliphatic hydrocarbon compound (manufactured by Nippon Seiro Co., Ltd.: HNP-51, melting point: 78° C.): 20.0 parts by mass, an anionic surfactant (manufactured by DKS Co., Ltd.: NeoGen RK): 1.0 part by mass, and deionized water: 79.0 parts by mass were put in a mixing container equipped with a stirrer. The mixture was heated to 90° C. and was circulated to Cleamix W-Motion (manufactured by M Technique Co., Ltd.) to conduct dispersion treatment for 60 minutes under the following conditions:

rotor outer diameter: 3 cm, clearance: 0.3 mm, rotor rotation speed: 19000 rpm, and screen rotation speed: 19000 rpm.

After the dispersion treatment, cooling to 40° C. was performed under cooling treatment conditions of a rotor rotation speed of 1000 rpm, a screen rotation speed of 0 rpm, and a cooling rate of 10° C./min to obtain an aqueous dispersion (aliphatic hydrocarbon compound fine particle dispersion) having an aliphatic hydrocarbon compound fine particle concentration of 20%. The aliphatic hydrocarbon compound fine particles had a 50% particle size (d50) based on volume distribution of 0.15 μm measured with a dynamic light scattering particle size analyzer (Nanotrac, manufactured by Nikkiso Co., Ltd.).

Production of Silicone Oil Emulsion

The following materials:

silicone oil (dimethyl silicone oil manufactured by Shin-Etsu Chemical Co., Ltd.: KF96-50CS): 20.0 parts by mass, an anionic surfactant (manufactured by DKS Co., Ltd.: NeoGen RK): 1.0 parts by mass, and deionized water: 79.0 parts by mass were mixed and dissolved, followed by dispersion of the silicone oil with a high-pressure impact disperser Nanomizer (manufactured by Yoshida Kikai Co., Ltd.) for about 1 hour to prepare an aqueous emulsion having a silicone oil concentration of 20%. The silicone oil particles in the resulting silicone oil emulsion had a volume median diameter of 0.09 μm measured with a dynamic light scattering particle size analyzer (Nanotrac, manufactured by Nikkiso Co., Ltd.).

Example 1

The following materials:

resin fine particle 1 dispersion: 500 g, coloring agent fine particle dispersion: 80 g, aliphatic hydrocarbon compound fine particle dispersion: 150 g, silicone oil emulsion: 50 g, and deionized water: 160 g were put in a stainless steel round flask and were mixed, and 60 g of a 10% magnesium sulfate aqueous solution was then added thereto, followed by dispersion treatment with a homogenizer (manufactured by IKA: Ultra-Turrax T50) at 5000 rpm for 10 minutes. Subsequently, the mixture solution was heated up to 73° C. in a water bath for heating with stirring while appropriately adjusting the number of rotation of a stirring blade such that the mixture solution was stirred. After retaining at 73° C. for 20 minutes, the volume average particle diameter of the resulting aggregated particles was measured with Coulter Multisizer III to confirm that aggregated particles having a volume average particle diameter of about 6.0 μm were formed.

Further, 330 g of a 5% sodium ethylenediaminetetraacetate aqueous solution was added to the dispersion of the aggregated particles, followed by heating up to 98° C. with continuously stirring. The mixture was then maintained at 98° C. for 1 hour to fuse the aggregated particles.

Subsequently, crystallization of the ethylene-vinyl acetate copolymer was accelerated by cooling down to 50° C. and retaining it for 3 hours. After further cooling down to 25° C., filtration was carried out for solid-liquid separation. The residue was washed with a 0.5% sodium ethylenediaminetetraacetate aqueous solution and further with deionized water. After completion of the washing, drying with a vacuum dryer was performed to obtain toner particles having a volume median diameter of 5.4 μm.

Based on 100 parts by mass of the resulting toner particles, 1.5 parts by mass of hydrophobized silica fine particles having a primary particle diameter of 10 nm and 2.5 parts by mass of hydrophobized silica fine particles having a primary particle diameter of 100 nm were dry-mixed with a Henschel mixer (manufactured by Nippon Coke & Engineering Co., Ltd.) to obtain a toner. The composition of the resulting toner is shown in Table 1.

Example 2

A toner was prepared as in Example 1 except that resin fine particle 1 dispersion was replaced with resin fine particle 2 dispersion. The resulting toner particles had a volume median diameter of 5.3 μm.

Example 3

A toner was prepared as in Example 1 except that resin fine particle 1 dispersion was replaced with resin fine particle 3 dispersion. The resulting toner particles had a volume median diameter of 5.3 μm.

Example 4

A toner was prepared as in Example 1 except that resin fine particle 1 dispersion was replaced with resin fine particle 4 dispersion. The resulting toner particles had a volume median diameter of 5.2 μm.

Example 5

A toner was prepared as in Example 1 except that resin fine particle 1 dispersion was replaced with resin fine particle 5 dispersion. The resulting toner particles had a volume median diameter of 5.5 μm.

Example 6

A toner was prepared as in Example 1 except that resin fine particle 1 dispersion was replaced with resin fine particle 6 dispersion. The resulting toner particles had a volume median diameter of 5.2 μm.

Example 7

A toner was prepared as in Example 1 except that resin fine particle 1 dispersion was replaced with resin fine particle 7 dispersion. The resulting toner particles had a volume median diameter of 5.1 μm.

Example 8

A toner was prepared as in Example 1 except that the amount of the aliphatic hydrocarbon compound fine particle dispersion was 50 g. The resulting toner particles had a volume median diameter of 5.2 μm.

Example 9

A toner was prepared as in Example 1 except that the amount of the aliphatic hydrocarbon compound fine particle dispersion was 75 g. The resulting toner particles had a volume median diameter of 5.1 μm.

Example 10

A toner was prepared as in Example 1 except that the 500 g of resin fine particle 1 dispersion was replaced with 375 g of resin fine particle 1 dispersion and 125 g of resin fine particle 19 dispersion. The resulting toner particles had a volume median diameter of 6.1 μm.

Example 11

A toner was prepared as in Example 1 except that resin fine particle 1 dispersion was replaced with resin fine particle 8 dispersion. The resulting toner particles had a volume median diameter of 5.2 μm.

Example 12

A toner was prepared as in Example 1 except that resin fine particle 1 dispersion was replaced with resin fine particle 9 dispersion. The resulting toner particles had a volume median diameter of 5.1 μm.

Example 13

A toner was prepared as in Example 1 except that resin fine particle 1 dispersion was replaced with resin fine particle 10 dispersion. The resulting toner particles had a volume median diameter of 5.1 μm.

Example 14

A toner was prepared as in Example 1 except that the 500 g of resin fine particle 1 dispersion was replaced with 250 g of resin fine particle 1 dispersion and 250 g of resin fine particle 8 dispersion. The resulting toner particles had a volume median diameter of 5.0 μm.

Example 15

A toner was prepared as in Example 1 except that resin fine particle 1 dispersion was replaced with resin fine particle 11 dispersion. The resulting toner particles had a volume median diameter of 5.2 μm.

Example 16

A toner was prepared as in Example 1 except that 330 g of a 5% sodium ethylenediaminetetraacetate aqueous solution was further added and the heating temperature was 90° C. The resulting toner particles had a volume median diameter of 5.2 μm.

Example 17

The following materials:
resin fine particle 1 dispersion: 400 g,
coloring agent fine particle dispersion: 80 g,
aliphatic hydrocarbon compound fine particle dispersion: 150 g,
silicone oil emulsion: 50 g, and
deionized water: 160 g
were put in a stainless steel round flask and were mixed, and 60 g of a 10% magnesium sulfate aqueous solution was then added thereto, followed by dispersion treatment with a homogenizer (manufactured by IKA: Ultra-Turrax T50) at 5000 rpm for 10 minutes. Subsequently, the mixture solution was heated up to 73° C. in a water bath for heating with stirring while appropriately adjusting the number of rotation of a stirring blade such that the mixture solution was stirred. After retaining at 72° C. for 15 minutes, the volume average particle diameter of the resulting aggregated particles was measured with Coulter Multisizer III to confirm that aggregated particles having a volume average particle diameter of about 4.5 μm were formed.

Subsequently, 100 g of resin fine particle 3 dispersion was added to the dispersion, followed by retaining at 73° C. for 10 minutes to form aggregated particles. The volume average particle diameter of the resulting aggregated particles was measured with Coulter Multisizer III to confirm that aggregated particles having a volume average particle diameter of about 5.5 μm were formed.

Further, 330 g of a 5% sodium ethylenediaminetetraacetate aqueous solution was added to the dispersion of the aggregated particles, followed by heating up to 98° C. with stirring. The mixture was then maintained at 98° C. for 1 hour to fuse the aggregated particles.

Subsequently, crystallization of the ethylene-vinyl acetate copolymer was accelerated by cooling down to 50° C. and retaining it for 3 hours. After further cooling down to 25° C., filtration was carried out for solid-liquid separation. The residue was washed with a 0.5% sodium ethylenediaminetetraacetate aqueous solution and further with deionized water. After completion of the washing, drying with a vacuum dryer was performed to obtain toner particles having a volume median diameter of 5.4 μm.

Based on 100 parts by mass of the resulting toner particles, 1.5 parts by mass of hydrophobized silica fine particles having a primary particle diameter of 10 nm and 2.5 parts by mass of hydrophobized silica fine particles having a primary particle diameter of 100 nm were dry-mixed with a Henschel mixer (manufactured by Nippon Coke & Engineering Co., Ltd.) to obtain a toner. The composition of the resulting toner is shown in Table 1.

Example 18

A toner was prepared as in Example 17 except that resin fine particle 3 dispersion was replaced with resin fine particle 21 dispersion. The resulting toner particles had a volume median diameter of 5.2 μm.

Comparative Example 1

A toner was prepared as in Example 1 except that resin fine particle 1 dispersion was replaced with resin fine particle 12 dispersion. The resulting toner particles had a volume median diameter of 5.1 μm.

Comparative Example 2

A toner was prepared as in Example 1 except that resin fine particle 1 dispersion was replaced with resin fine particle 13 dispersion. The resulting toner particles had a volume median diameter of 5.3 μm.

Comparative Example 3

A toner was prepared as in Example 1 except that resin fine particle 1 dispersion was replaced with resin fine particle 14 dispersion. The resulting toner particles had a volume median diameter of 5.5 μm.

Comparative Example 4

A toner was prepared as in Example 1 except that resin fine particle 1 dispersion was replaced with resin fine particle 15 dispersion. The resulting toner particles had a volume median diameter of 5.4 μm.

Comparative Example 5

A toner was prepared as in Example 1 except that resin fine particle 1 dispersion was replaced with resin fine particle 16 dispersion. The resulting toner particles had a volume median diameter of 6.8 μm.

Comparative Example 6

A toner was prepared as in Example 1 except that resin fine particle 1 dispersion was replaced with resin fine particle 17 dispersion. The resulting toner particles had a volume median diameter of 10.3 μm.

Comparative Example 7

A toner was prepared as in Example 1 except that resin fine particle 1 dispersion was replaced with resin fine particle 18 dispersion. The resulting toner particles had a volume median diameter of 11.0 μm.

Comparative Example 8

A toner was prepared as in Example 1 except that resin fine particle 1 dispersion was replaced with resin fine particle 19 dispersion, the amount of the aliphatic hydrocarbon compound fine particle dispersion was 50 g, the silicone oil emulsion was not used, and the temperature in the step (2) was 60° C. The resulting toner particles had a volume median diameter of 5.4 μm.

Comparative Example 9

A toner was prepared as in Example 1 except that resin fine particle 1 dispersion was replaced with resin fine particle 20 dispersion, the amount of the aliphatic hydrocarbon compound fine particle dispersion was 50 g, the silicone oil emulsion was not used, and the temperature in the step (2) was 60° C. The resulting toner particles had a volume median diameter of 5.4 μm.

The toners prepared above were evaluated by the following tests. The results of evaluation are shown in Table 2.

Evaluation of Storage Stability (Blocking Resistance)

The toners were left to stand in a thermo-hygrostat at a temperature of 50° C. and a humidity of 50% for 3 days and were then visually evaluated for degree of blocking as follows:

A: no blocking occurs, or even if blocking occurs, the blocking is easily dispersed by light vibration, B: blocking occurs, but is dispersed by continuous vibration, C: blocking occurs and is not dispersed even if a force is applied.

Evaluation of High-Humidity Storage Stability

The toners were left to stand in a thermo-hygrostat at a temperature of 40° C. and a humidity of 95% for 30 days and were then visually evaluated for degree of blocking as follows:

A: no blocking occurs, or even if blocking occurs, the blocking is easily dispersed by light vibration, B: blocking occurs, but is dispersed by continuous vibration, C: blocking occurs and is not dispersed even if a force is applied.

Evaluation of Low-Temperature Fixability

The toners were each mixed with a ferrite carrier (average particle diameter: 42 μm) prepared by coating the surface of a carrier core with a silicone resin to prepare two-component developers each having a toner concentration of 8 mass %.

An unfixed toner image (0.6 mg/cm$^2$) was formed on image receiving paper (64 g/m$^2$) with a commercially available full-color digital copier (CLC1100, manufactured by CANOAN KABUSHIKI KAISHA). The fixing unit detached from a commercially available full-color digital copier (image RUNNER ADVANCE C5051, manufactured by CANOAN KABUSHIKI KAISHA) was remodeled so that the fixing temperature can be regulated and was used for a fixing test of unfixed images. Under normal temperature and normal humidity, the situation when an unfixed image was fixed at a process speed of 246 mm/sec was visually evaluated as follows:

A: fixing is possible at a temperature of 120° C. or less,

B: fixing is possible at a temperature of higher than 120° C. and 140° C. or less, C: fixing is possible at a temperature of higher than 140° C. and 200° C. or less or fixing is impossible in the whole temperature range.

Evaluation of Resistance to Rubbing with Eraser

The toners were fixed by the same method as that in the evaluation of low-temperature fixability, and fixed objects were tested for erasing resistance at the highest fixable temperature with an eraser (product name: MONO, manufactured by Tombow Pencil Co., Ltd.) and were evaluated as follows:

A: the image is not erased with the eraser,

B: the density of the image decreased by erasing with the eraser,

C: the image is erased with the eraser.

Evaluation of Toner Adherence after Idling

A mixture of 225 g of a ferrite carrier (average particle diameter: 42 μm) surface-coated with a silicone resin and 25 g of any of the toners was charged in the developing unit of a full-color copier CANON image RUNNER ADVANCE C5051, and a stress is applied to the developer by idling (no toner supply), followed by evaluation of images. This evaluation was performed for evaluating accelerated durability at a low printing ratio, i.e., in a state where the toner is hardly replaced. Specifically, idling was performed with a developing idling gear for image RUNNER ADVANCE under a high-temperature and high-humidity environment (42° C./41% Rh) at a velocity of 370 rpm for 3 hours. Subsequently, the carrier was removed from the developer to produce each toner sample.

The adherence of each toner sample was measured with a centrifugal adhesion measuring apparatus NS-C100 model (manufactured by Nano Seeds Corporation), which is mainly composed of an image analysis unit and a centrifugation unit.

Measuring Method

Each toner sample was attached to a stainless steel (SUS) substrate, and the substrate was then fixed to a sample cell. Centrifugation at four levels, 40000 rotations, 60000 rotations, 80000 rotations, and 150000 rotations, was carried out with a high-speed centrifuge. The separation states of the toner samples were recorded.

On this occasion, the separating force applied to the toner was calculated from the true specific gravity and the particle diameter of the toner, the number of rotations, and the rotation radius.

The residual rate R of the toner amount after each rotation to the initial toner amount attached to the substrate was measured. The residual rate was plotted on the vertical axis, and the separating force was plotted on the horizontal axis. From the approximate straight line, the rate of the residual toner at a separating force of 240 nN was defined as rate R (240 nN) of the toner having an adherence of 240 nN or more, and the evaluation was performed as follows:

A: R (240 nN)≤5%,

B: 5%<R (240 nN)≤10%,

C: 10%<R (240 nN)≤30%,

D: 30%<R (240 nN).

Evaluation of Charge Retention

In an aluminum pan is weighed 0.01 g of a toner. The toner was charged to −600 V with a Scorotron charging apparatus. Subsequently, the changing behavior in the surface potential was measured for 30 minutes under an environment of a temperature of 30° C. and a humidity of 80% with a surface potential meter (manufactured by Trek Japan K.K., model 347). The charge retention was calculated from the measurement results by the following expression:

Charge retention (%) after 30 min=(surface potential after 30 min/initial surface potential)×100, and the evaluation was performed as follows:

A: charge retention≥90%,

B: 90%>charge retention≥50%,

C: 50%>charge retention≥10%,

D: 10%>charge retention.

TABLE 1

| | Ester group-containing olefin copolymer | | | | | | |
|---|---|---|---|---|---|---|---|
| Example No. | Category | Fine particle No. | Proportion (mass %) of unit derived from Formula (2) or (3) | Acid value (mg-KOH/g) | Melt flow rate (g/10 min) | Melting point (° C.) | Rupture elongation (%) |
| Example 1 | EVA-A | 1 | 15 | 0 | 12 | 86 | 700 |
| Example 2 | EVA-A | 2 | 15 | 0 | 12 | 86 | 700 |
| Example 3 | EVA-A | 3 | 15 | 0 | 12 | 86 | 700 |
| Example 4 | EVA-B | 4 | 20 | 0 | 14 | 75 | 800 |
| Example 5 | EVA-C | 5 | 28 | 0 | 20 | 69 | 800 |
| Example 6 | EVA-D | 6 | 6 | 0 | 75 | 96 | 460 |
| Example 7 | EVA-A | 7 | 15 | 0 | 12 | 86 | 700 |
| Example 8 | EVA-A | 1 | 15 | 0 | 12 | 86 | 700 |
| Example 9 | EVA-A | 1 | 15 | 0 | 12 | 86 | 700 |
| Example 10 | EVA-A | 1 | 15 | 0 | 12 | 86 | 700 |
| Example 11 | EEA-A | 8 | 25 | 0 | 20 | 91 | 900 |
| Example 12 | EMA-A | 9 | 14 | 0 | 14 | 87 | 800 |
| Example 13 | EMMA-A | 10 | 18 | 0 | 7 | 89 | 750 |

TABLE 1-continued

| | | | | | | | |
|---|---|---|---|---|---|---|---|
| Example 14 | EVA-A | 1 + 8 | 20 | 0 | 18 | 88 | 800 |
| | EEA-A | | | | | | |
| Example 15 | EVA-E | 11 | 14 | 0 | 14 | 83 | 750 |
| Example 16 | EVA-A | 1 | 15 | 0 | 12 | 86 | 700 |
| Example 17 | EVA-A | 1 | 15 | 0 | 12 | 86 | 700 |
| | EVA-A | 3 | 15 | 0 | 12 | 86 | 700 |
| Example 18 | EVA-A | 1 | 15 | 0 | 12 | 86 | 700 |
| | EVA-A | 21 | 15 | 0 | 12 | 86 | 700 |
| Comparative Example 1 | EVA-A | 12 | 15 | 0 | 12 | 86 | 700 |
| Comparative Example 2 | EVA-A | 13 | 15 | 0 | 12 | 86 | 700 |
| Comparative Example 3 | EVA-F | 14 | 2 | 0 | 3 | 105 | 600 |
| Comparative Example 4 | EVA-G | 15 | 41 | 0 | 2 | 40 | 870 |
| Comparative Example 5 | EVA-H | 16 | 20 | 0 | 200 | 75 | 210 |
| Comparative Example 6 | EVA-A | 17 | 15 | 0 | 12 | 86 | 700 |
| Comparative Example 7 | EEA-A | 18 | 25 | 0 | 20 | 91 | 900 |
| Comparative Example 8 | — | 19 | — | | — | — | — |
| Comparative Example 9 | — | 20 | — | | — | — | — |

| | Acid group-containing olefin copolymer | | | | Proportion (mass %) of ester | Proportion (mass %) of acid | Amount based on 100 parts by mass of rein component | |
|---|---|---|---|---|---|---|---|---|
| Example No. | Type | Acid value (mg-KOH/g) | Melt flow rate (g/10 min) | Melting point (° C.) | group-containing olefin copolymer in resin component | group-containing olefin copolymer in resin component | Aliphatic hydrocarbon compound (parts by mass) | Silicone oil (parts by mass) |
| Example 1 | A | 90 | 60 | 90 | 80 | 20 | 30 | 10 |
| Example 2 | A | 90 | 60 | 90 | 90 | 10 | 30 | 10 |
| Example 3 | A | 90 | 60 | 90 | 70 | 30 | 30 | 10 |
| Example 4 | A | 90 | 60 | 90 | 80 | 20 | 30 | 10 |
| Example 5 | A | 90 | 60 | 90 | 80 | 20 | 30 | 10 |
| Example 6 | A | 90 | 60 | 90 | 80 | 20 | 30 | 10 |
| Example 7 | B | 60 | 500 | 95 | 80 | 20 | 30 | 10 |
| Example 8 | A | 90 | 60 | 90 | 80 | 20 | 10 | 10 |
| Example 9 | A | 90 | 60 | 90 | 80 | 20 | 20 | 10 |
| Example 10 | A | 90 | 60 | 90 | 60 | 20 | 30 | 10 |
| Example 11 | A | 90 | 60 | 90 | 80 | 20 | 30 | 10 |
| Example 12 | A | 90 | 60 | 90 | 80 | 20 | 30 | 10 |
| Example 13 | A | 90 | 60 | 90 | 80 | 20 | 30 | 10 |
| Example 14 | A | 90 | 60 | 90 | 80 | 20 | 30 | 10 |
| Example 15 | A | 90 | 60 | 90 | 80 | 20 | 30 | 10 |
| Example 16 | A | 90 | 60 | 90 | 80 | 20 | 30 | 10 |
| Example 17 | A | 90 | 60 | 90 | 78 | 22 | 30 | 10 |
| | A | 90 | 60 | 90 | | | | |
| Example 18 | A | 90 | 60 | 90 | 74 | 26 | 30 | 10 |
| | A | 90 | 60 | 90 | | | | |
| Comparative Example 1 | C | 12 | 130 | 90 | 80 | 0 | 30 | 10 |
| Comparative Example 2 | D | 30 | 33 | 88 | 80 | 0 | 30 | 10 |
| Comparative Example 3 | A | 90 | 60 | 90 | 0 | 20 | 30 | 10 |
| Comparative Example 4 | A | 90 | 60 | 90 | 0 | 20 | 30 | 10 |
| Comparative Example 5 | — | — | — | — | 100 | 0 | 30 | 10 |
| Comparative Example 6 | — | — | — | — | 100 | 0 | 30 | 10 |
| Comparative Example 7 | — | — | — | — | 100 | 0 | 30 | 10 |
| Comparative Example 8 | A | 90 | 60 | 90 | 0 | 20 | 10 | 0 |
| Comparative Example 9 | — | — | — | — | 0 | 0 | 10 | 0 |

TABLE 2

| | Results of evaluation of toner | | | | | | | |
|---|---|---|---|---|---|---|---|---|
| Example No. | Carboxyl index (Ge) | Carboxyl index (Ge)/Carboxyl index (D) | Low-temperature fixability | Charge retention | Resistance to rubbing with eraser | Adherence | Storage stability | High-humidity storage stability |
| Example 1 | 0.29 | 1.4 | A | A | A | A | A | B |
| Example 2 | 0.15 | 1.2 | A | B | B | C | A | B |
| Example 3 | 0.35 | 1.5 | B | A | A | A | A | B |
| Example 4 | 0.22 | 1.4 | A | B | A | B | B | C |
| Example 5 | 0.20 | 1.4 | A | C | A | B | C | C |
| Example 6 | 0.35 | 1.3 | A | A | A | A | C | C |
| Example 7 | 0.18 | 1.2 | A | A | B | C | C | C |
| Example 8 | 0.28 | 1.4 | B | B | B | A | A | A |
| Example 9 | 0.30 | 1.4 | B | B | B | A | A | B |

TABLE 2-continued

| Example No. | Results of evaluation of toner | | | | | | | |
|---|---|---|---|---|---|---|---|---|
| | Carboxyl index (Ge) | Carboxyl index (Ge)/Carboxyl index (D) | Low-temperature fixability | Charge retention | Resistance to rubbing with eraser | Adherence | Storage stability | High-humidity storage stability |
| Example 10 | 0.29 | 1.4 | B | A | A | A | B | C |
| Example 11 | 0.22 | 1.3 | B | A | A | A | A | A |
| Example 12 | 0.28 | 1.4 | B | A | A | B | A | A |
| Example 13 | 0.28 | 1.5 | B | A | A | B | A | A |
| Example 14 | 0.29 | 1.4 | B | A | A | A | A | B |
| Example 15 | 0.28 | 1.4 | B | A | A | A | A | B |
| Example 16 | 0.11 | 1.0 | A | A | B | D | A | B |
| Example 17 | 0.37 | 2.2 | A | A | A | A | A | B |
| Example 18 | 0.42 | 2.6 | B | B | A | A | A | B |
| Comparative Example 1 | — | — | B | A | C | — | B | B |
| Comparative Example 2 | — | — | B | A | C | — | A | B |
| Comparative Example 3 | — | — | C | A | B | — | A | C |
| Comparative Example 4 | — | — | A | D | A | — | C | B |
| Comparative Example 5 | — | — | A | A | C | — | C | B |
| Comparative Example 6 | — | — | C | A | C | — | A | C |
| Comparative Example 7 | — | — | C | A | C | — | A | C |
| Comparative Example 8 | — | — | C | A | A | — | B | B |
| Comparative Example 9 | — | — | A | D | A | — | B | A |

The present disclosure can provide a toner having excellent low-temperature fixability, chargeability, and adhesiveness to paper.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-091437 filed Apr. 28, 2016, which is hereby incorporated by reference herein in its entirety.

What is claimed is:

1. A toner comprising:

a toner particle containing a resin component, wherein the resin component contains:

an ester group-containing olefin copolymer, and an acid group-containing olefin copolymer;

the ester group-containing olefin copolymer includes:

a unit Y1 represented by Formula (1), and a unit Y2 composed of at least one member selected from the group consisting of units represented by Formula (2) and units represented by Formula (3);

the ester group-containing olefin copolymer has an acid value of 10 mg KOH/g or less, and the acid group-containing olefin copolymer has an acid value of 50 mg KOH/g or more and 300 mg KOH/g or less;

the content of the ester group-containing olefin copolymer in the resin component is 50 mass % or more based on the total mass of the resin component; and the content of the unit Y2 in the ester group-containing olefin copolymer is 3 mass % or more and 35 mass % or less based on the total mass of the ester group-containing olefin copolymer, (1)

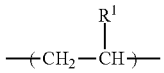

(2)

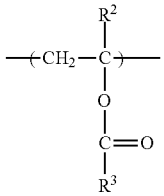

(3)

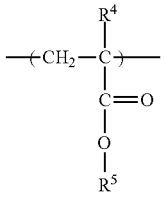

in Formulae (1) to (3), $R^1$ denotes H or $CH_3$, $R^2$ denotes H or $CH_3$, $R^3$ denotes $CH_3$ or $C_2H_5$, $R^4$ denotes H or $CH_3$, and $R^5$ denotes $CH_3$ or $C_2H_5$.

2. The toner according to claim 1, wherein the total mass denoted by W of the ester group-containing olefin copolymer, and the mass denoted by 1 of the unit represented by Formula (1), the mass denoted by m of the unit represented by Formula (2), and the mass denoted by n of the unit represented by Formula (3) in the ester group-containing olefin copolymer satisfy the following relationship: $(l+m+n)/W \geq 0.80$.

3. The toner according to claim 1, wherein the content of the acid group-containing olefin copolymer in the resin component is 10 mass % or more and 50 mass % or less based on the total mass of the resin component.

4. The toner according to claim 1, wherein the toner has a surface layer containing the acid group-containing olefin copolymer, and has a carboxyl index and an ester index measured by a Fourier transform infrared-attenuated total reflection (FT-IR-ATR) method satisfying the following Expressions (1) and (2):

$$0.15 \leq \text{carboxyl index } (Ge) \leq 0.40 \quad (1)$$

$$1.2 \leq \text{carboxyl index } (Ge)/\text{carboxyl index } (D) \leq 2.4 \quad (2).$$

5. The toner according to claim 1, wherein the ester group-containing olefin copolymer has a melt flow rate of 5 g/10 min or more and 30 g/10 min or less.

6. The toner according to claim 1, wherein the toner particle contains an aliphatic hydrocarbon compound having a melting point of 50° C. or more and 100° C. or less; and the content of the aliphatic hydrocarbon compound in the toner particle is 1 part by mass or more and 40 parts by mass or less based on 100 parts by mass of the resin component in the toner particle.

7. The toner according to claim 1, wherein the content of the unit Y2 in the ester group-containing olefin copolymer is 5 mass % or more and 20 mass % or less based on the total mass of the ester group-containing olefin copolymer.

8. The toner according to claim 1, wherein the toner particle contains silicone oil; and the content of the silicone oil in the toner particle is 1 part by mass or more and 20 parts by mass or less based on 100 parts by mass of the resin component in the toner particle.

9. A toner comprising:

a toner particle containing a resin component, wherein the resin component contains:

an ethylene-vinyl acetate copolymer, and at least one copolymer selected from the group consisting of ethylene-acrylic acid copolymers and ethylene-methacrylic acid copolymers;

the content of the ethylene-vinyl acetate copolymer in the resin component is 50 mass % or more based on the total mass of the resin component; and the content of the unit derived from vinyl acetate in the ethylene-vinyl acetate copolymer is 3 mass % or more and 35 mass % or less based on the total mass of the ethylene-vinyl acetate copolymer.

10. A method of producing a toner, comprising:

producing resin fine particles in an aqueous solvent in the presence of a surfactant;

aggregating the resin fine particles to produce aggregated particles; and fusing the aggregated particles by heating to produce toner particles, wherein the resin fine particles contain a resin component;

the resin component contains:

an ester group-containing olefin copolymer, and an acid group-containing olefin copolymer;

the ester group-containing olefin copolymer includes:

a unit Y1 represented by Formula (1), and a unit Y2 composed of at least one member selected from the group consisting of units represented by Formula (2) and units represented by Formula (3);

the ester group-containing olefin copolymer has an acid value of 10 mg KOH/g or less, and the acid group-containing olefin copolymer has an acid value of 50 mg KOH/g or more and 300 mg KOH/g or less;

the content of the ester group-containing olefin copolymer in the resin component is 50 mass % or more based on the total mass of the resin component; and the content of the unit Y2 in the ester group-containing olefin copolymer is 3 mass % or more and 35 mass % or less based on the total mass of the ester group-containing olefin copolymer, (1)

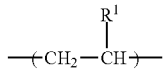

(2)

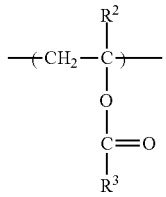

(3)

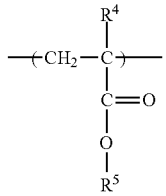

in Formulae (1) to (3), $R^1$ denotes H or $CH_3$, $R^2$ denotes H or $CH_3$, $R^3$ denotes $CH_3$ or $C_2H_5$, $R^4$ denotes H or $CH_3$, and $R^5$ denotes $CH_3$ or $C_2H_5$.

* * * * *